United States Patent [19]

Cerny

[11] 4,085,820

[45] Apr. 25, 1978

[54] LADDER LEVELER

[76] Inventor: Louis F. Cerny, 2594 Chase St., Denver, Colo. 80214

[21] Appl. No.: 813,163

[22] Filed: Jul. 5, 1977

[51] Int. Cl.[2] ..... E06C 7/44

[52] U.S. Cl. ..... 182/204; 24/230 AS

[58] Field of Search ..... 182/204, 201, 205; 403/108; 24/206 B, 230 AS

[56] References Cited

U.S. PATENT DOCUMENTS

| | | | |
|---|---|---|---|
| 407,227 | 7/1889 | May | 24/230 AS |
| 1,251,192 | 12/1917 | Drummond | 182/204 |
| 1,280,741 | 10/1918 | Hunn | 182/204 |
| 2,223,911 | 12/1940 | Garnette | 182/204 |
| 3,484,814 | 12/1969 | Meehan | 182/204 |
| 3,933,222 | 1/1976 | Craig | 182/204 |

FOREIGN PATENT DOCUMENTS

| | | | |
|---|---|---|---|
| 565,900 | 8/1957 | Italy | 24/230 AS |
| 423,363 | 5/1965 | Switzerland | 403/108 |

*Primary Examiner*—Reinaldo P. Machado

[57] ABSTRACT

A leveling device for ladders, consisting of a spring loaded latch mechanism, which includes arms having oppositely opposed ends, which will normally engage an outer and inner rail at different slot positions, so as to level a ladder. The arms of the latch mechanism include a portion which is finger depressible, so as to disengage the oppositely opposed arms from the various slot positions.

2 Claims, 2 Drawing Figures

LADDER LEVELER

This invention relates to ladders, and more particularly, to a ladder leveler.

It is, therefore, the principal object of this invention to provide a ladder leveler, which will enable the user to easily and quickly level a ladder.

Another object of this invention is to provide a ladder leveler, which may be adapted for use with one or both legs of a ladder.

A further object of this invention is to provide a ladder leveler, which may be incorporated in the structure of newly manufactured ladders, as well as being installed on ladders that are already in use.

Other objects of the invention are to provide a ladder leveler, which is simple in design, inexpensive to manufacture, rugged in construction, easy to use and efficient in operation.

Figure 2:
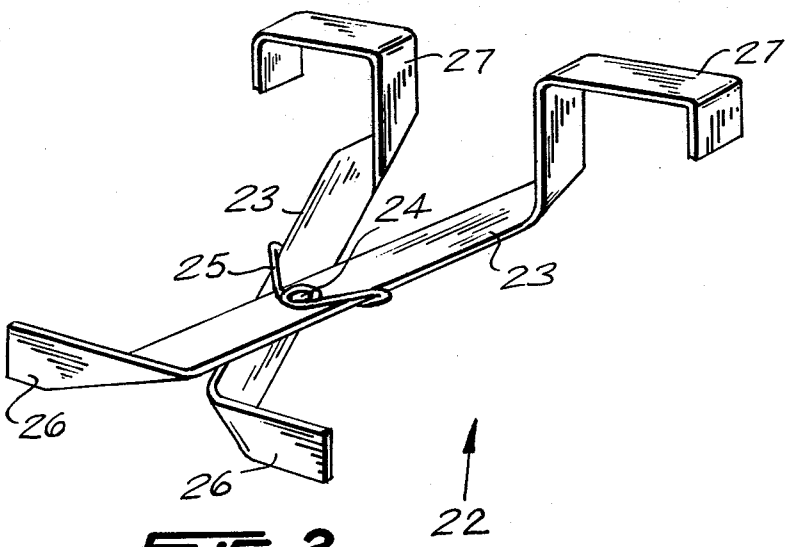
Figure 1:
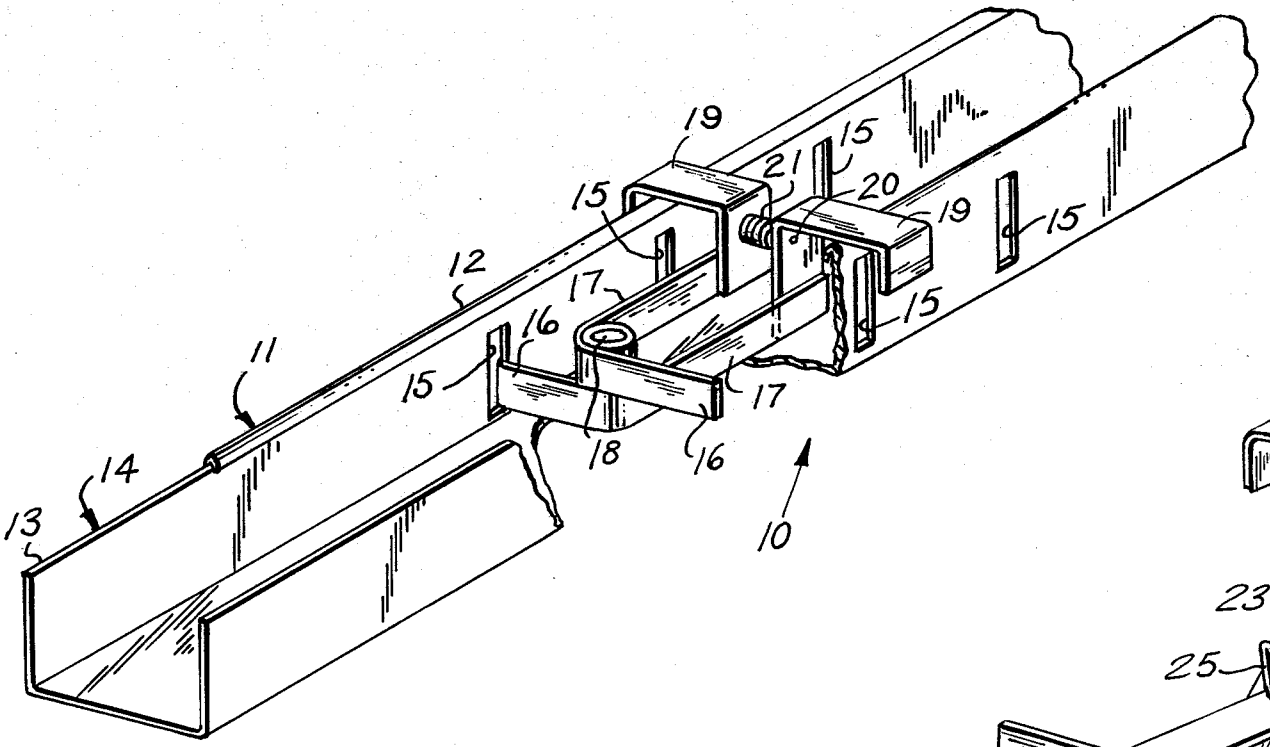

These, and other objects, will be readily evident, upon a study of the following specification, and the accompanying drawing, wherein:

FIG. 1 is a perspective view of the present invention, shown partly broken away; and FIG. 2 is a perspective view of a modified form of latching mechanism for the device.

According to this invention, a ladder leveler 10, is shown to include an outer rail 11, having a lip 12 portion which engages with edge 13 of inner rail 14. The inner and outer rails 14 and 11, are provided with equally spaced apart slots 15 in which are removably received oppositely opposed ends 16 of arms 17. Arms 17 are pivotally connected together by means of pin 18 at one end. A "U" shaped member 19 is fixedly secured to the opposite ends of arms 17 for a purpose which hereinafter will be described.

A pin 20 freely receives a compression spring 21 between "U" shaped members 19, and members 19 are urged together by finger pressure, so as to disengage ends 16 of arms 17, from the openings 15, when desired. When pressure is released from members 19, the ends 16 normally are urged outwards into openings 15, by means of spring 21.

Referring now to FIG. 2 of the drawing, a modified latch 22 is shown to include a pair of arms 23, which are pivotally secured together by means of pin 24, upon which is secured spring 25, which normally urges ends 26 outwards in a similar manner, as heretofore described in the main embodiment of the invention. The ends 26, of arms 23, serve to engage slots 15, as shown in FIG. 1 of the drawing. The opposite ends 27 of arms 23, are "U" shaped and integral of arms 23, and serve as a means of disengaging ends 26 from slots 15, when finger pressure is applied thereto.

While various changes may be made in the detail construction, it is understood that such changes will be within the spirit and scope of the present invention, as is defined by the appended claims.

What I now claim is:

1. A ladder leveler, comprising in combination, a latch mechanism, an inner rail and an outer rail, said rails each being of U-shaped transverse configuration, said inner rail being slidably fitted inside said outer rail, a plurality of equally spaced apart slots along opposite side walls of each said rail, a longitudinal edges of said outer rail being rolled around longitudinal edges of said inner rail; said mechanism comprising a pair of L-shaped arms, an inside corner of each said arm being around a side of a pivot-pin, a short leg of each said arm extending generally in opposite directions, while a long leg of said arms extend generally parallel to each other, a U-shaped member being affixed to an end of said long leg of each said arm, a compression coil spring between said members, whereby squeezing said members together cause the ends of said arm short legs to pivot about said pivot pin so to shorten a distance between said short arm ends, and thus be released from said outer rail slots and allow slide adjustment of said rails respective to each other.

2. The combination as set forth in claim 1, wherein each of said U-shaped member bridges across one said longitudinal edge of both said rails, an oute end of said U-shaped members being thus positioned for receiving a manual pressure for squeezing said spring therebetween.

* * * * *